US010948266B2

(12) United States Patent
Wells et al.

(10) Patent No.: US 10,948,266 B2
(45) Date of Patent: Mar. 16, 2021

(54) ATTACHABLE WEAPON LIGHT

(71) Applicant: SureFire, LLC, Fountain Valley, CA (US)

(72) Inventors: William Wells, Costa Mesa, CA (US); Loc Nguyen, Santa Ana, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 16/689,942

(22) Filed: Nov. 20, 2019

(65) Prior Publication Data

US 2020/0158473 A1 May 21, 2020

Related U.S. Application Data

(63) Continuation-in-part of application No. 29/670,906, filed on Nov. 20, 2018, now Pat. No. Des. 885,510.

(60) Provisional application No. 62/770,560, filed on Nov. 21, 2018.

(51) Int. Cl.

| | |
|---|---|
| ***F41G 11/00*** | (2006.01) |
| ***F41G 1/35*** | (2006.01) |
| ***F41G 1/34*** | (2006.01) |

(52) U.S. Cl.

CPC ..... *F41G 11/001* (2013.01); *F41G 1/345* (2013.01); *F41G 1/35* (2013.01)

(58) Field of Classification Search

CPC .... F41G 11/001; F41G 11/002; F41G 11/004; F41G 11/003; F41G 1/345; F41G 1/35

USPC ..... 42/117, 114, 132

See application file for complete search history.

(56) References Cited

U.S. PATENT DOCUMENTS

| | | | |
|---|---|---|---|
| 6,295,754 | B1 | 10/2001 | Otteman et al. |
| 7,188,978 | B2 | 3/2007 | Sharrah et al. |
| D628,323 | S | 11/2010 | Matthews et al. |
| D628,324 | S | 11/2010 | Matthews et al. |
| D651,628 | S | 1/2012 | Wang |
| D672,005 | S | 12/2012 | Hedeen et al. |
| D709,158 | S | 7/2014 | Wells |
| D712,001 | S | 8/2014 | Wells |

(Continued)

FOREIGN PATENT DOCUMENTS

| | | |
|---|---|---|
| WO | WO 2011/091018 | 7/2011 |
| WO | WO 2016/114995 | 7/2013 |

OTHER PUBLICATIONS

"7 Best Pistol Lights [2019 Hands-On Review]" [online]. Pewpewtactical.com [Published on Dec. 16, 2019]. Retrieved from the Internet https://www.pewpewtactical.com/best-pistol-lights/.

*Primary Examiner* — John Cooper
(74) *Attorney, Agent, or Firm* — Haynes and Boone, LLP

(57) ABSTRACT

A rail mountable device may be provided that is configured to be secured firmly to a rail. In one example, the rail mountable device may include a rail clamp that includes a screw, a screw receptacle, a first ramp member coupled to the screw, and a second ramp member coupled to the screw receptacle and configured to move relative to the screw receptacle. Additionally, the rail mountable device may include a removeable battery pack with a battery indicator. Furthermore, the rail mountable device may include a plurality of switches disposed on either side of the rail mountable device. The switches may be coupled to a bracket and a mode of the rail mountable device may be operated through manipulation of the switches. Additional embodiments and related methods are provided.

20 Claims, 17 Drawing Sheets

(56) References Cited

U.S. PATENT DOCUMENTS

| | | | | |
|---|---|---|---|---|
| D732,134 | S | 6/2015 | Wells | |
| D738,455 | S | 9/2015 | Homem de Mello Anderson et al. | |
| D762,806 | S | 8/2016 | Chavez et al. | |
| 9,459,078 | B1 * | 10/2016 | Kincel | F41G 11/004 |
| 9,551,550 | B2 | 1/2017 | Wells | |
| D781,983 | S * | 3/2017 | Wells | D22/108 |
| D790,097 | S | 6/2017 | Port | |
| D798,356 | S | 9/2017 | Grasheim | |
| D800,864 | S | 10/2017 | Hartley | |
| D807,981 | S | 1/2018 | Cheng et al. | |
| D812,178 | S | 3/2018 | Galli | |
| D830,491 | S | 10/2018 | Mock et al. | |
| 1,034,495 | A1 | 7/2019 | Worman et al. | |
| 10,344,959 | B2 * | 7/2019 | Worman | F21V 19/004 |
| D857,268 | S | 8/2019 | Worman | |
| D857,960 | S | 8/2019 | Worman | |
| D862,633 | S | 10/2019 | Tuller et al. | |
| 2008/0202010 | A1 | 8/2008 | Matthews et al. | |
| 2010/0176741 | A1 | 7/2010 | Sharrah et al. | |
| 2013/0133238 | A1 | 5/2013 | Quetschke et al. | |
| 2016/0209167 | A1 * | 7/2016 | Wells | F41C 27/00 |

* cited by examiner

ATTACHABLE WEAPON LIGHT

CROSS-REFERENCE TO RELATED APPLICATIONS

This patent application claims the benefit of and priority to U.S. Provisional Patent Application No. 62/770,560 filed Nov. 21, 2018 which is hereby incorporated by reference in its entirety.

This patent application is a continuation-in-part of U.S. Design patent application Ser. No. 29/670,906 filed Nov. 20, 2018 which is hereby incorporated by reference in its entirety.

TECHNICAL FIELD

This invention to accessory devices for firearms and, more specifically, to the mounting, operating, and charging of lighting devices for firearms.

BACKGROUND

It is often useful to mount an accessory device, such as a lighting device, to a rail that is secured to or integrated into a firearm (e.g., a handgun). Such an accessory device should be firmly secured to the rail as operation of the firearm typically involves the firearm experiencing significant forces. Furthermore, firearms are often exposed to harsh environments. The components and/or mechanisms used to secure the accessory device should be configured to withstand such harsh environments. Additionally, accessory devices are often left secured to the handgun. As such, accessory devices should be serviceable when secured to the firearm.

Conventional apparatuses for mounting of accessory devices are typically complicated and require large numbers of moving parts. For this reason, the accessory devices can be difficult to install and remove and can be prone to failure due to failure of one or more of the moving parts. This can be problematic, particularly in military or police operations in which failures or excessive time or energy to install, remove, or service the accessory device can be dangerous. Moreover, conventional apparatuses for mounting of accessory devices can be bulky and heavy and can therefore negatively affect the aiming of the firearm when mounted and can be difficult to install on small firearms such as handguns. It would therefore be desirable to provide improved systems and methods for mounting of accessory devices to a rail and for servicing such accessory devices.

SUMMARY

In one embodiment, a rail mountable device configured to mount on a rail associated with a weapon may be provided. The rail mountable device may include a housing and a rail clamp. The rail clamp may include a screw receptacle, a screw configured to be threaded into the screw receptacle, a first ramp member coupled to the screw and configured to move relative to the screw, and a second ramp member coupled to the screw receptacle and configured to move relative to the screw receptacle. The screw and the screw receptacle may be configured to be pulled toward each other in response to a rotation of the screw about an axis in a first direction. The first ramp member and the second ramp member may be configured to be pulled toward each other in response to the pulling together of the screw and the screw receptacle.

In another embodiment, a method may include providing a device configured to mount on a rail associated with a weapon. The device may include a housing and a rail clamp. The rail clamp may include a screw receptacle, a screw configured to be threaded into the screw receptacle, a first ramp member coupled to the screw and configured to move relative to the screw, and a second ramp member coupled to the screw receptacle and configured to move relative to the screw receptacle. The method may include coupling the housing to the rail. The method may also include rotating the screw. The screw and the screw receptacle may be configured to be pulled toward each other in response to a rotation of the screw about an axis in a first direction. The first ramp member and the second ramp member may be configured to be pulled toward each other in response to the pulling together of the screw and the screw receptacle to lock the device with respect to the weapon.

In another embodiment, a removable battery pack may be provided that may be recharged while a remainder of a rail mountable device remains attached to a weapon. In another embodiment, a bracket and user operable switches may be provided.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

In accordance with various embodiments provided herein, a rail mountable device may be implemented to easily mount and service an accessory onto the rail of a firearm. Such a rail mountable device may be used in any desired combination with various features identified in the present disclosure. In certain embodiments, a rail mountable device may be particularly suited for use in tactical and combat environments (e.g., for mounting a light source on a weapon or other device).

In various embodiments, the rail mountable device may include a removable battery pack and a rail clamp. The rail clamp may include a plurality of ramp members, each ramp member coupled to a screw type device. The ramp members may be configured to move independently of other components of the rail clamp. The rail mountable device may further include switches disposed on opposites side of the rail mountable device and a bracket coupled to the switches to allow operation of the rail mountable device.

Figure 1A:
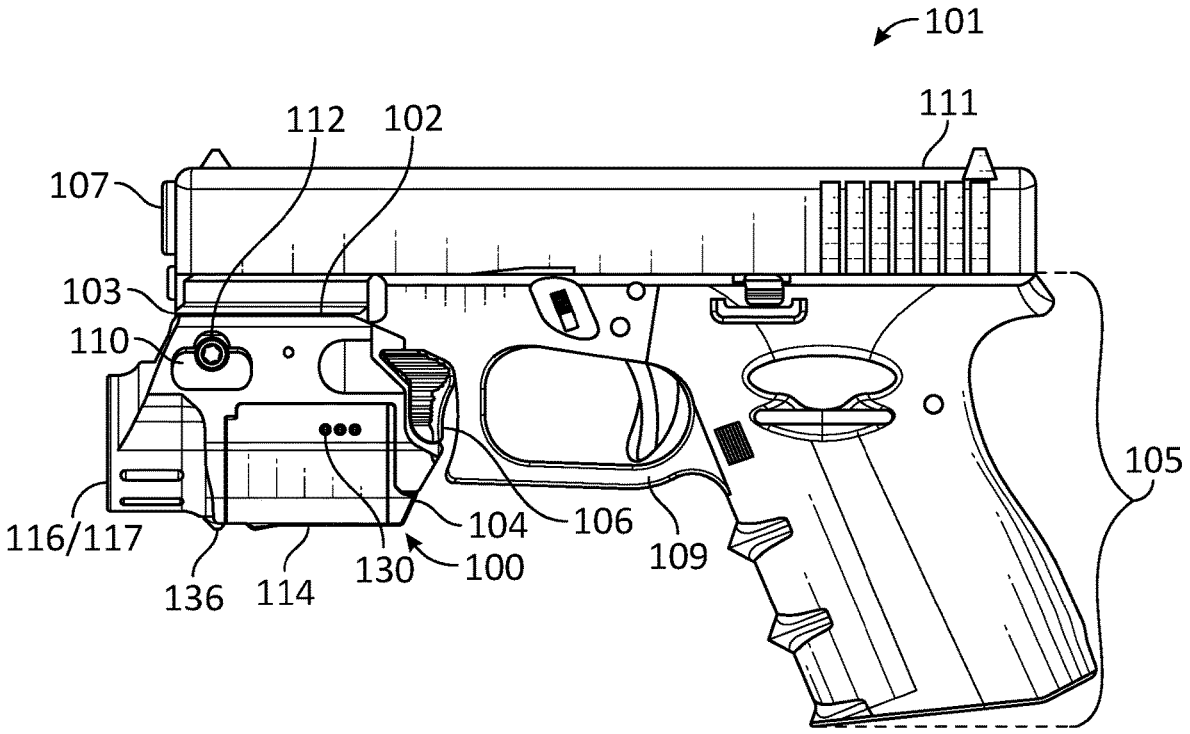
FIGS. 1A-B illustrate views of a rail mountable device attached to a weapon in accordance with embodiments of the disclosure.
Figure 1B:
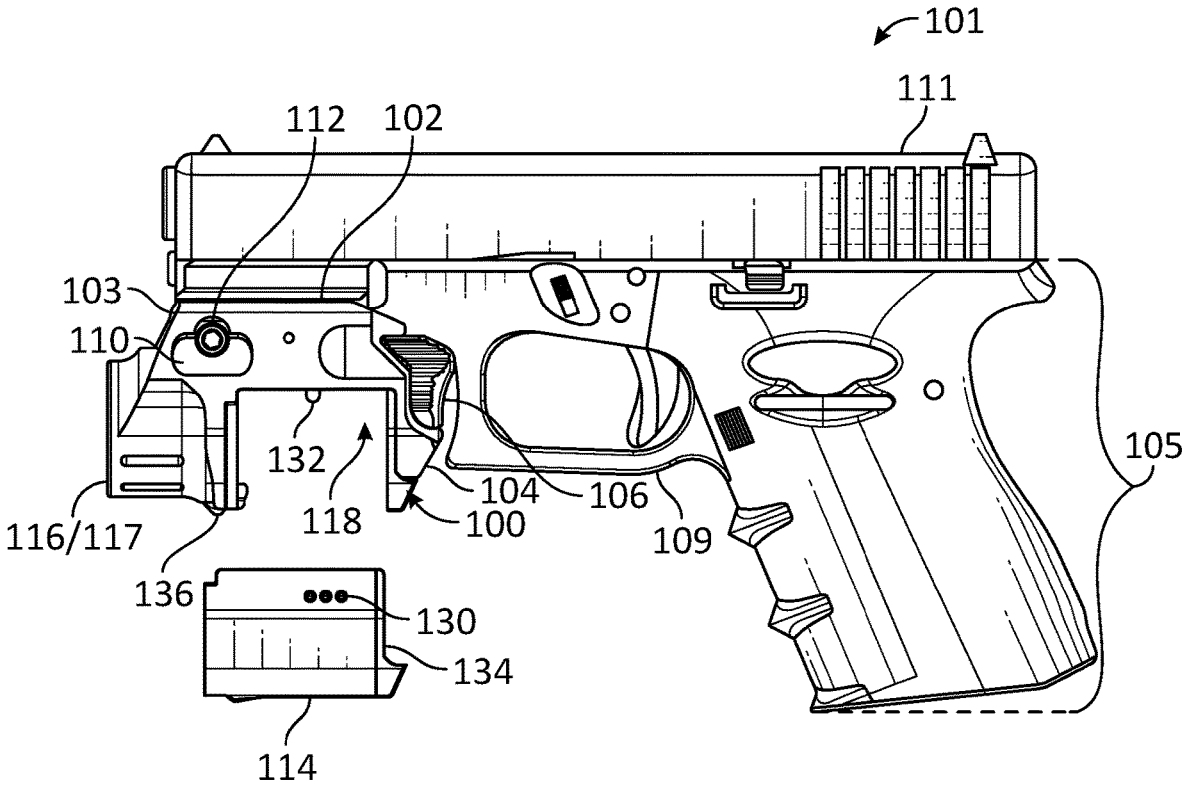

Referring now to the drawings, wherein the drawings are for purposes of illustrating embodiments of the present invention only and not for purposes of limiting the same, FIGS. 1A-B illustrate views of a rail mountable device attached to a weapon in accordance with embodiments of the disclosure. As shown in FIG. 1A, rail mountable device 100 may be mounted to rail 103 of firearm 101 (e.g., a handgun or other type of weapon). Rail 103 may be, for example, a Picatinny rail, a custom sized rail, or universal rail, of firearm 101 that runs along the length of the barrel of firearm 101. Indeed, any desired rail size may be used as appropriate. Rail mountable device 100 may include a housing 104 (sometimes referred to as a main housing). Housing 104 may include various features configured to mount rail mountable device 100 to a rail such as rail 103.

For example, rail mountable device 100 may be secured to rail 103, at least in part, with one or more rail engaging member 102. Rail engaging member 102 may, in certain embodiments, be integrated within a portion of housing 104. Rail 103 may be integrated with or removably secured at various locations of frame 105 of firearm 101. In the example of FIG. 1A, rail 103 is located beneath the barrel 107 of firearm 101 and forward of the trigger guard 109 of firearm 101. As shown, firearm 101 may additionally include slide 111 coupled to barrel 107. In some embodiments, rail 103 may have at least one groove or slot that is configured to receive and/or interface with rail engaging member 102.

As shown in FIG. 1A, rail mountable device 100 may include switch 106, screw 112, and battery indicator 130. As shown, screw 112 may be disposed in ramp member 110 (e.g., within an opening of ramp member 110) and may thread into screw receptacle 118 (shown in FIG. 2A and elsewhere). Manipulation of screw 112 by a user may allow for adjustment of how tightly rail mountable device 100 couples to rail 103.

Switch 106 may provide a user of rail mountable device 100 with the ability to operate electronic components of rail mountable device 100 such as one or more light sources 117 disposed within housing 104 and configured to project light (e.g., a beam of visible light, infrared light, ultraviolet light, laser light, and/or light of any desired wavelength) from rail mountable device 100 (e.g., in the direction in which firearm 101 is aimed such as a direction defined by the barrel 107).

Battery indicator 130 may provide information related to a charge level of a battery pack 114 of rail mountable device 100. Battery pack 114 may be removable (e.g., by manipulating battery release 136). Once removed, battery pack 114 may be rechargeable and/or may be manipulated to have battery indicator 130 provide information as to the charge level of battery pack 114. Battery pack 114 may include features configured to aid in coupling or securing battery pack 114 to main housing 104.

FIG. 1B illustrates a situation where battery pack 114 is removed from main housing 104. As shown, main housing 104 may include an opening 115 configured to receive battery pack 114. Battery pack 114 includes contacts that are configured to electrically couple to contacts 132 disposed on main housing 104. When battery pack 114 is fully engaged with main housing 104, contacts 132 electrically couple to contacts of battery pack 114 and, thus, battery pack 114 may power one or more electrical components (e.g., light source 117) of rail mountable device 100.

In various embodiments, battery pack 114 may be selectively coupled to and decoupled from rail mountable device 100. For example, battery pack 114 may be configured to be removed and/or replaced when the rest of rail mountable device 100 (e.g., housing 104) is coupled to firearm 101. Thus, for example, battery pack 114 may be inserted into and removed from a bottom facing (as defined by normal operation of firearm 101) portion of rail mountable device 100. Such a configuration may allow for battery pack 114 to be conveniently swapped without removal of rail mountable device 100 (e.g., if battery pack 114 is disposed and removed from a rearward portion of rail mountable device 100, removal of rail mountable device 100 may be necessary to swap battery pack 114).

To allow for removal of battery pack 114 from the bottom of rail mountable device 100, contacts may be disposed on a top portion of battery pack 114 and contacts 132 may be correspondingly disposed on a bottom facing portion of main housing 104. In other embodiments, contacts 132 may be disposed on other portions of main housing 104 (e.g., on side portions of main housing 104). Battery pack 114 may position corresponding contacts 156 to interface with contacts 132. Thus, if battery pack 114 where to position contacts 156 on a side (e.g. a front side or a rear side) of battery pack 114, main housing 104 may include contacts 132 disposed on a corresponding side (e.g., a corresponding front or rear side) of main housing 104. Contacts 132 and/or the contacts of battery pack 114 may include contacts such as pogo pins to allow for positive engagement between the contacts.

Figure 2A:
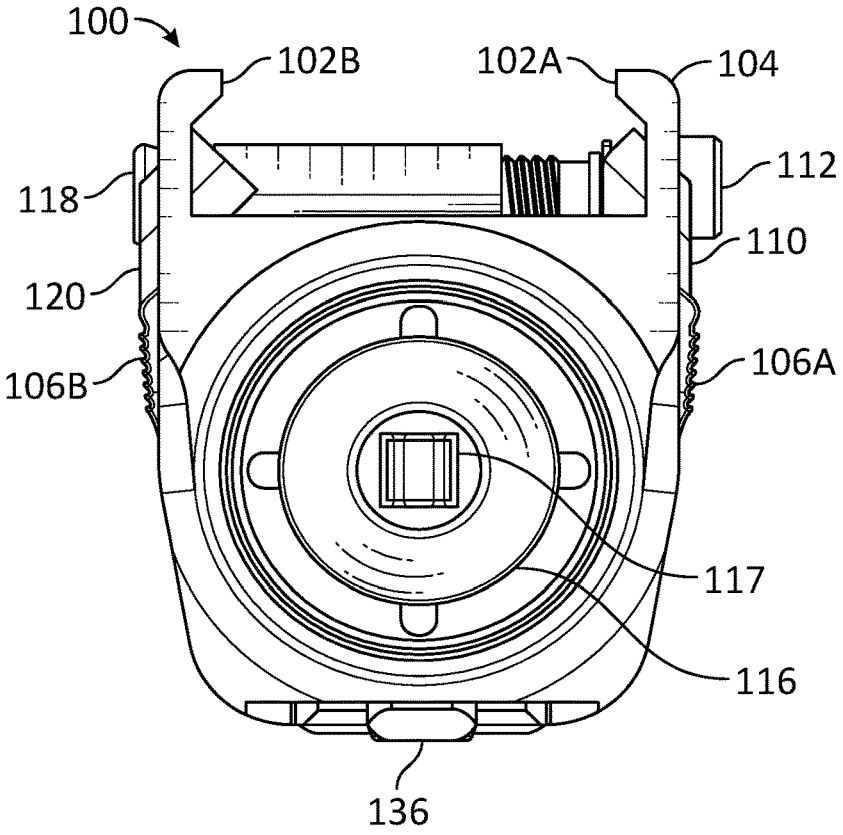
FIGS. 2A-I illustrate views of a rail mountable device in accordance with embodiments of the disclosure.
Figure 2B:
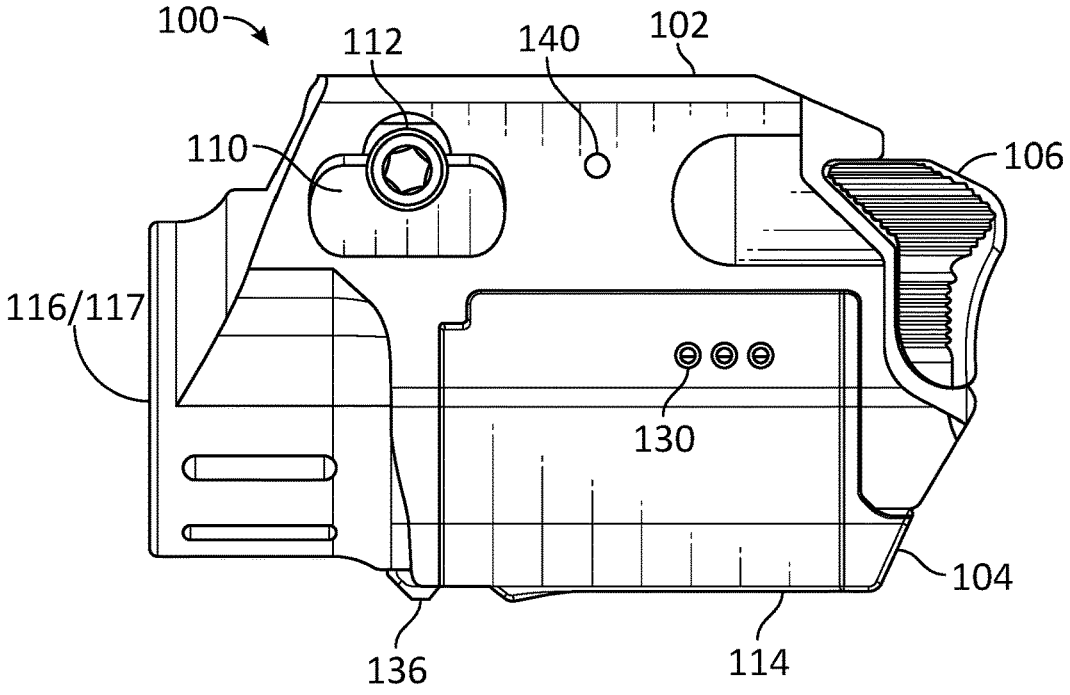
Figure 2D:
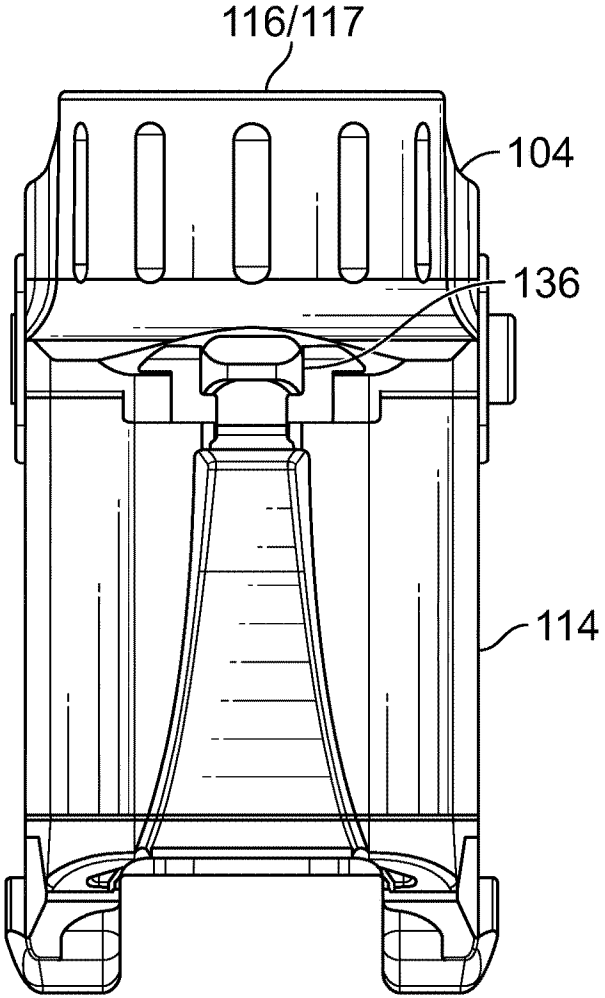
Figure 2C:
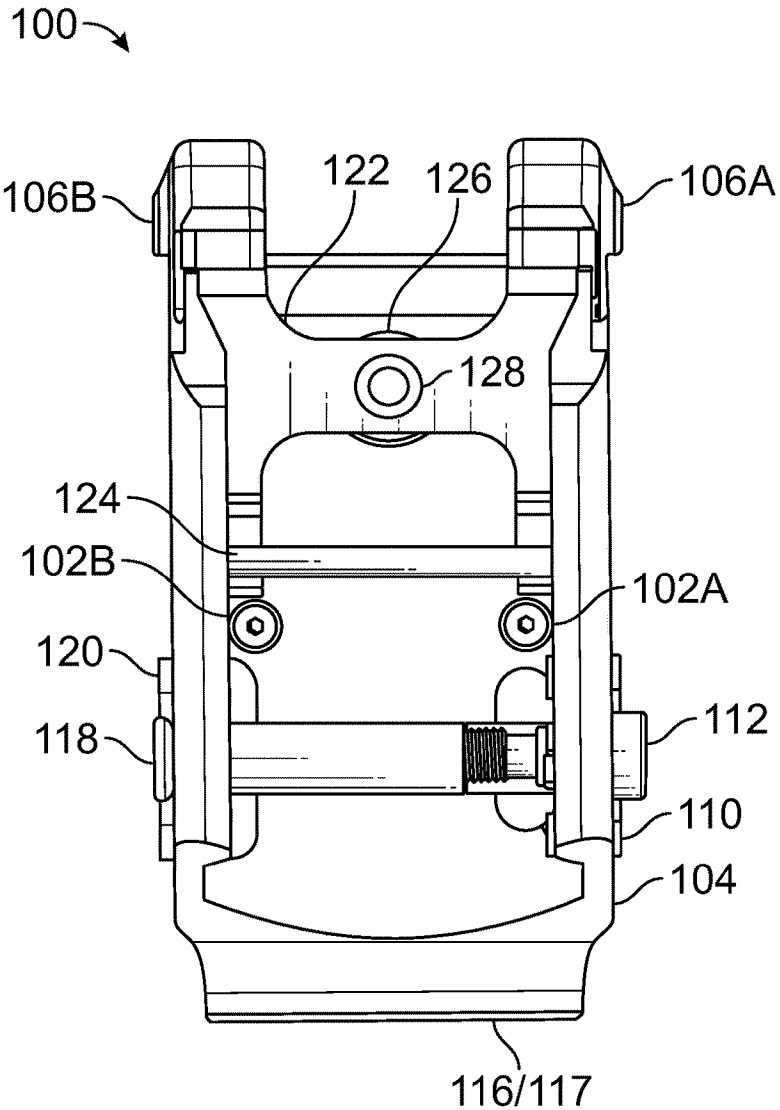
Figure 2E:
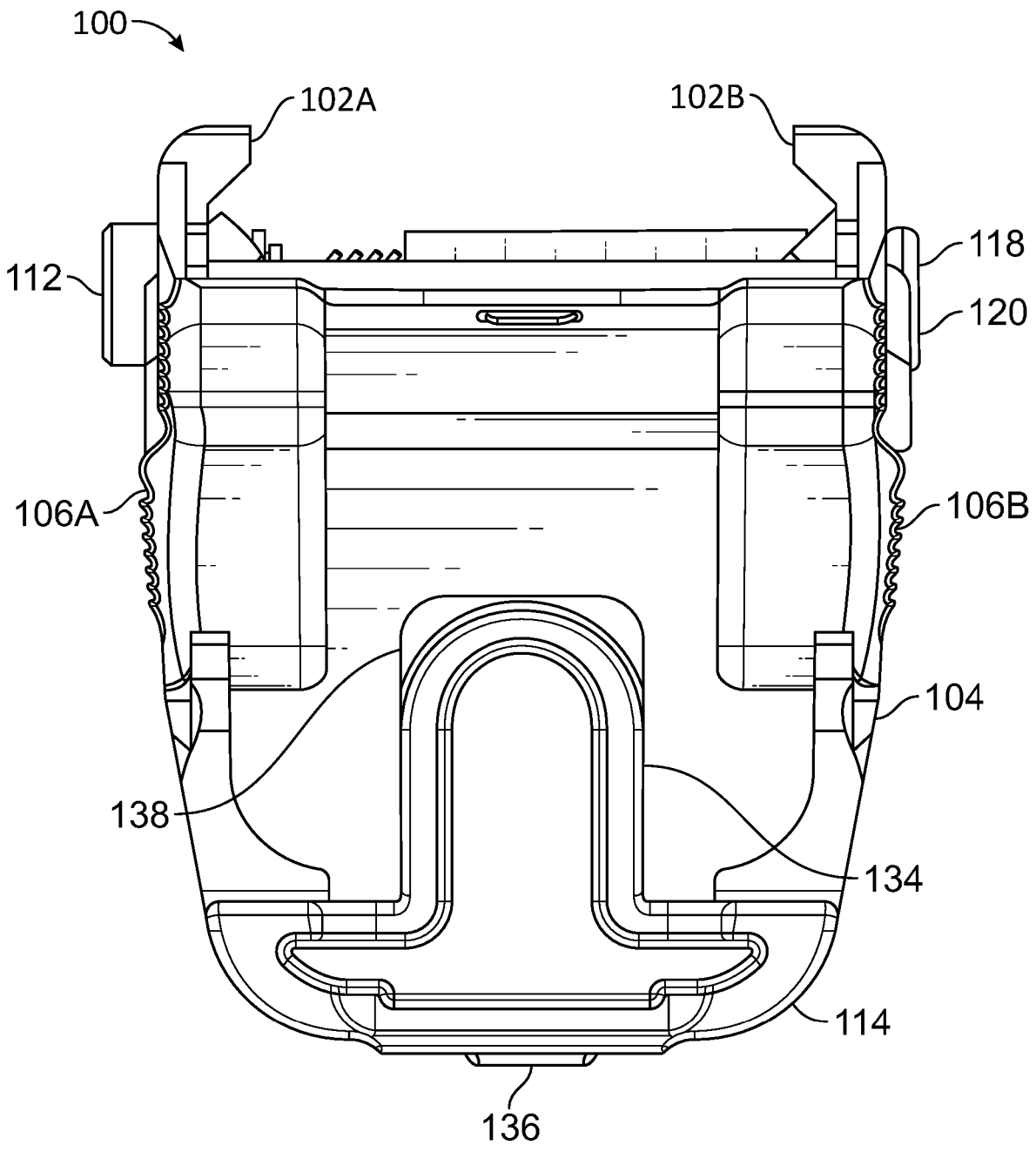
Figure 2F:
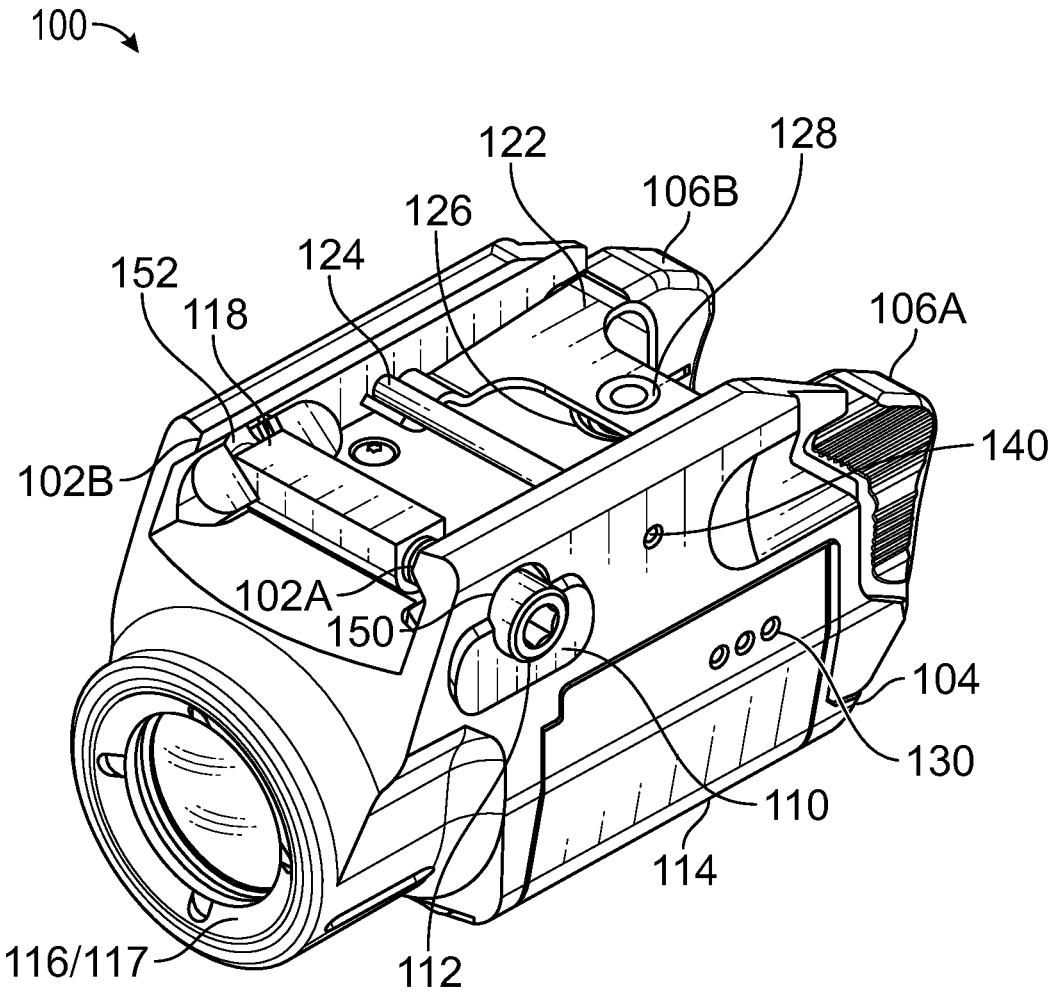
Figure 2G:
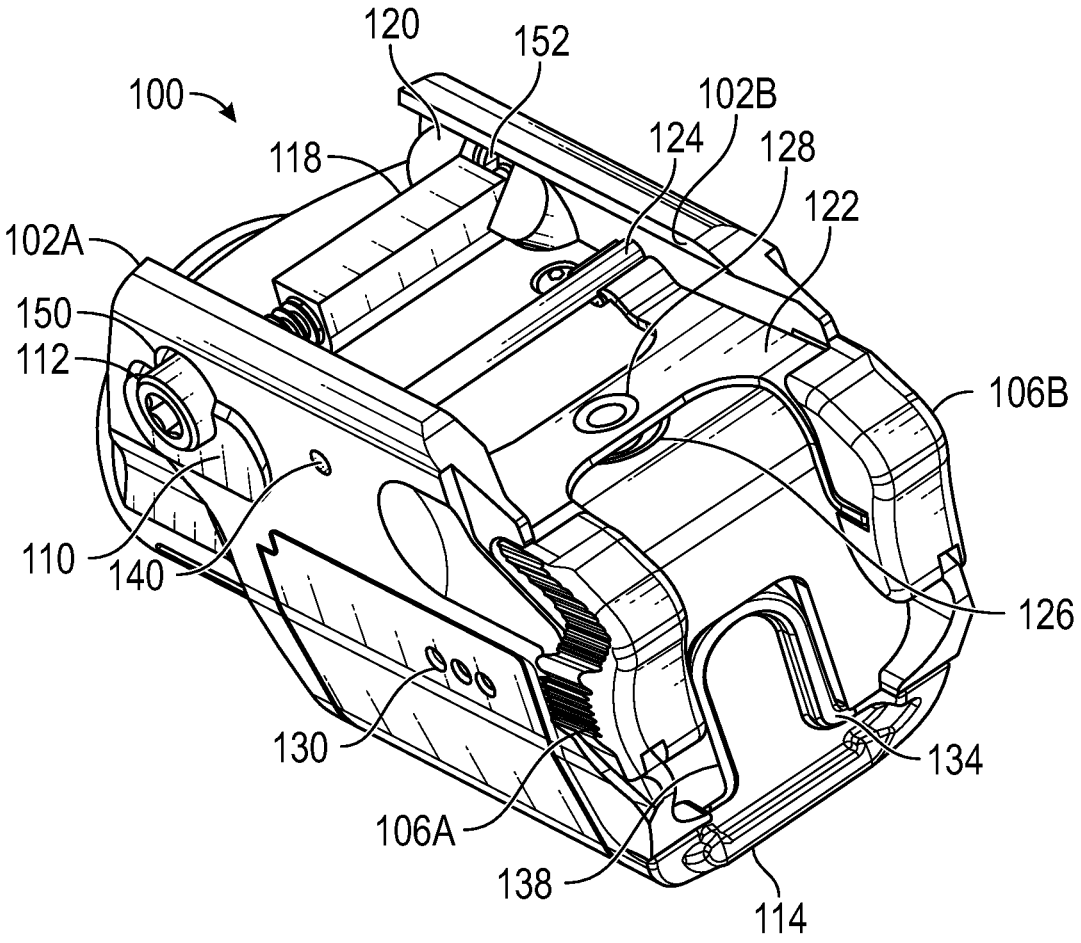
Figure 2H:
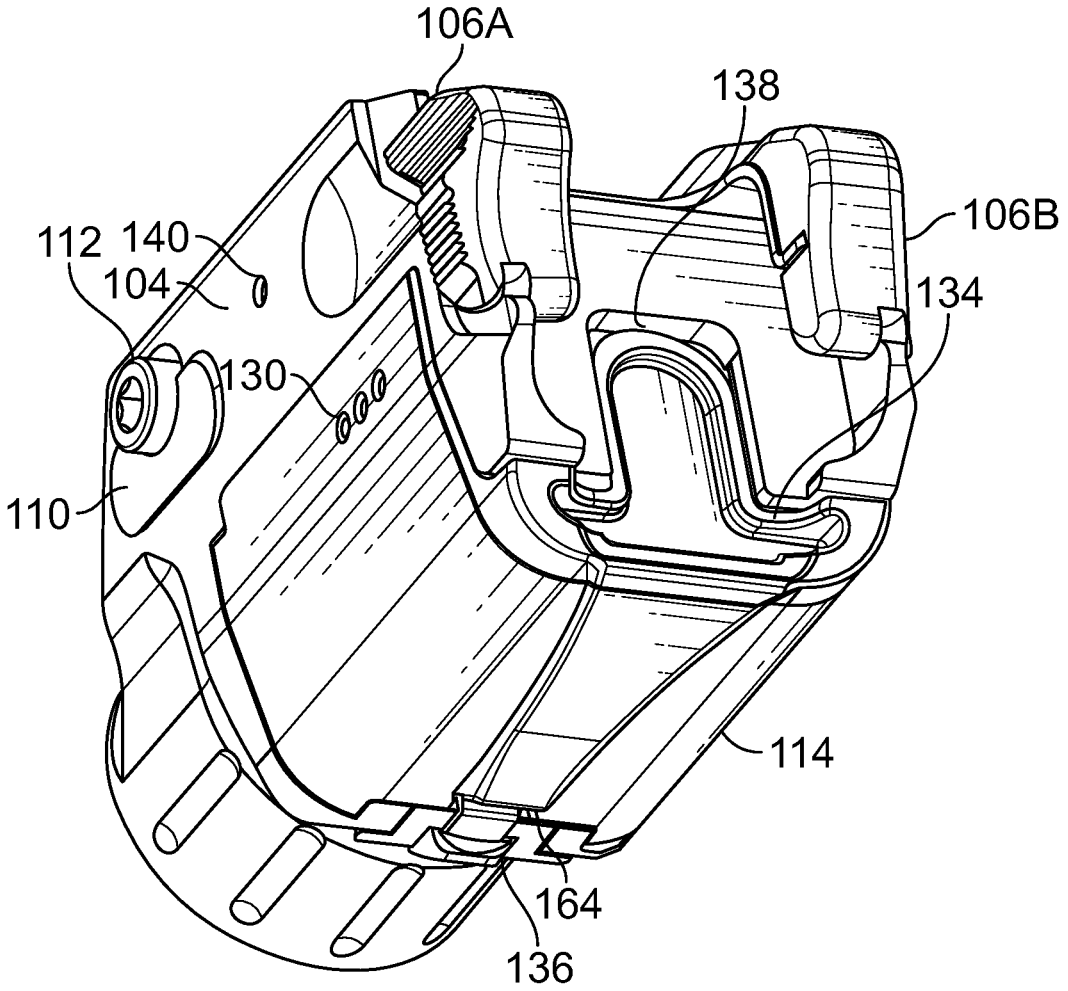
Figure 2I:
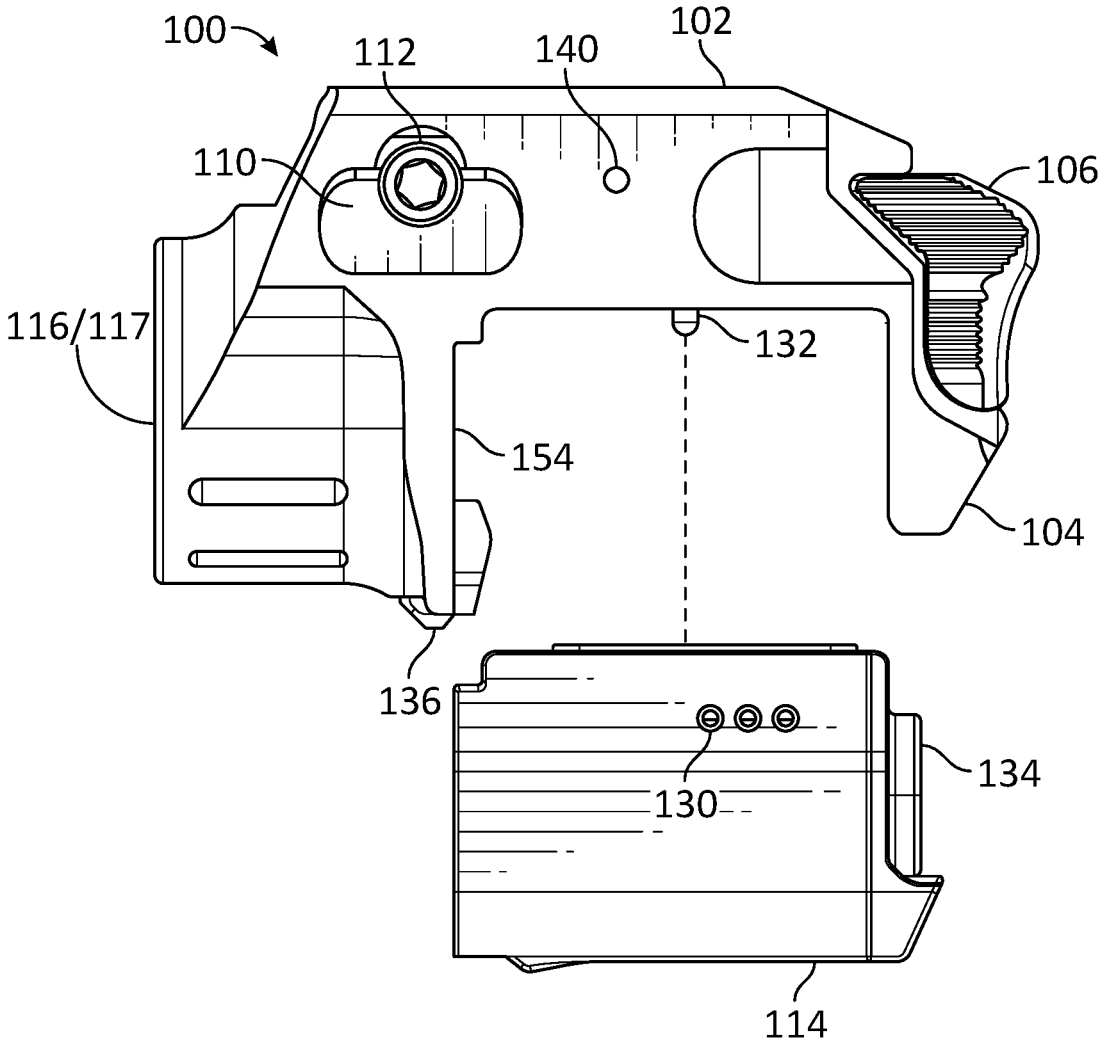

FIGS. 2A-I illustrate views of a rail mountable device in accordance with embodiments of the disclosure. FIG. 2A shows a front view, FIG. 2B shows a side view, FIG. 2C shows a top view, FIG. 2D shows a bottom view, FIG. 2E shows a back view, FIG. 2F shows an isometric view, FIG. 2G shows a top perspective view, and FIG. 2H shows a bottom perspective view of rail mountable device 100 disengaged from any firearm. FIG. 2I shows a side view of rail mountable device 100 with battery pack 114 disengaged.

As shown in FIGS. 2A-I, main housing 104 includes rail engaging members 102A and 102B on a portion of main housing 104. Rail engaging members 102A and 102B may be configured to couple to either side of frame 105 and/or barrel 107 via rails 103 (e.g., rail engaging members 102A and 102B may be configured to couple to the left and right side of rails 103). Rail engaging members 102A and 102B may include one or more features, such as angled surfaces, that are configured to be complementary to and couple to rails 103.

Ramp members 110 and 120 may be coupled to main housing 104 and may be adapted to receive screw 112 and screw receptacle 118, respectively. Screw 112 may be threaded into screw receptacle 118. Screw 112 may be disposed within an opening of ramp member 110 and one or more portions of screw 112 (e.g., a back of the screwhead of screw 112) may be configured to contact a portion of ramp member 110 and exert a force on ramp member 110 when screw 112 and screw receptacle 118 are tightened. Likewise, screw receptacle 118 may be disposed within an opening of ramp member 120 and tightening of screw 112 and screw receptacle 118 may result in screw receptacle 118 contacting a portion of ramp member 120 to exert a force on ramp member 120.

As such, screw 112 may be rotated about an axis to pull screw 112 and screw receptacle 118 together (e.g., to decrease a distance between a portion of screw 112 relative to a portion of screw receptacle 118). Such tightening may result in screw 112 exerting a force on ramp member 110 and screw receptacle 118 exerting a force on ramp member 120 to pull together rail-engaging members 102A and 102B and, further, may result in rail-engaging members 102A and 102B being tightened on rails 103.

Figure 10:
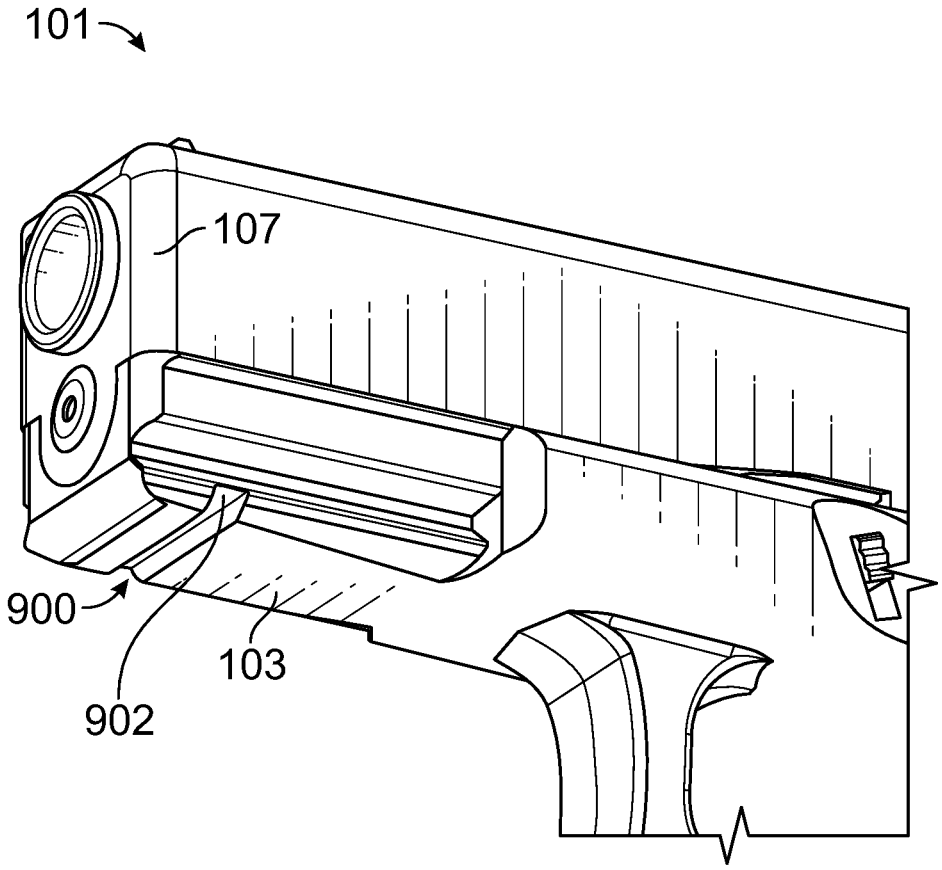
FIG. 10 illustrates a view of a firearm having a rail with a transverse groove in accordance with an embodiment of the disclosure.

FIG. 10 illustrates a view of a firearm having a rail with a transverse groove in accordance with an embodiment of the disclosure. In particular, FIG. 10 illustrates a transverse groove 900 (e.g., a slot) on rail 103 of firearm 101. Transverse groove 900 may run perpendicularly to an elongated dimension of rail 103 and/or to an elongated dimension of barrel 107. Screw receptacle 118 and/or another portion of rail clamp 500 of rail mountable device 100 may be configured to be positioned such that, when rail mountable device 100 is coupled to rail 103, screw receptacle 118 and/or another portion of rail clamp 500 is disposed within groove 900 to help prevent forward and backward movement of rail mountable device 100 along rail 103. In certain embodiments, screw receptacle 118 and/or another portion of rail clamp 500 may be configured to contact surface 902 of groove 900 or another portion of rail 103 to further prevent movement of rail mountable device 100.

Battery pack 114 may be coupled to main housing 104. Battery release 136 may be, for example, a switch, latch, or other mechanism that holds battery pack 114 to main housing 104 and, when manipulated by a user (e.g., by pressing down or pressing battery release 136 in a direction), may allow for battery pack 114 to be decoupled from main housing 104. Battery pack 114 may be a battery pack of any electrical characteristic, such as any voltage (e.g., around approximately 2, 3, 4, 5, or 6 volts) to power light source 117 and/or other components of rail mountable device 100.

Battery pack 114 may further include battery indicator 130. Battery indicator 130 may include one or more indicators (e.g., light emitting diode "LED" lights) that communicate a level of charge of battery pack 114. Certain embodiments may include a plurality of lights and the level of charge of battery pack 114 may be indicated by the amount of lights illuminated. Other embodiments may include one or more lights that change colors and the level of charge may be indicated at least partially by the color of the one or more lights.

Battery pack 114 may include one or more features configured to allow battery pack 114 and/or rail mountable device 100 to operate in environments and conditions typically associated with firearms. For example, battery pack 114 may include raised ribs 134 configured to be inserted into and/or interface with opening 138 of main housing 104. When battery pack 114 is coupled to main housing 104, ribs 134 can be located proximate to or touch one or more sidewalls of opening 138. Such a configuration allows for greater support for battery pack 114. For example, if battery pack 114 and/or main housing 104 experiences a lateral force, ribs 134 may contact a sidewall of opening 138 and forces may be transferred to main housing 104 from battery pack 114, reducing the amount of stress experienced by battery pack 114 and reducing the potential for damage to battery pack 114.

Additionally, rail mountable device 100 may include switches 106A and 106B on sides of main housing 104 (e.g., on the left and right side of main housing 104). Switches 106A and/or 106B may be configured to allow a user to change an operating configuration of one or more components of rail mountable device 100. For example, a user may manipulate switches 106A and/or 106B to change an operating mode of light source 117 (e.g., on, off, and/or intermediate light levels). Switches 106A and 106B may be located on different sides of main housing 104 to allow a user to change the operating mode of light source 117 with a plurality of hand positions. Such a configuration allows a user to change the operating mode of light source 117 regardless of hand position preferences when holding firearm 101.

In various embodiments, light source 117 may be a light emitting diode (LED), an incandescent light bulb, or another type of component that emits light in any desired wavelength as discussed. Light emitted from light source 117 may be emitted through optics 116 (e.g., one or more lenses such as a total internal reflection (TIR) lens and/or other implementations). Optics 116 may at least partially cover light source 117 and may focus, color, and/or otherwise direct light from light source 117.

Switches 106A and 106B may be coupled to bracket 122. Bracket 122 may be, for example, a component at least partly composed of metallic (e.g., sheetmetal), composite, plastic, or other materials. Bracket 122 may be configured to translate and/or rotate (e.g., pivot around dowel 124) when switch 106A and/or 106B is manipulated. Bracket 122 may be shaped so that movement of switches 106A and 106B may be transferred to a different plane. For example, bracket 122 may be operated by being pushed downward or in another direction and bracket 122 may be shaped so that such operation may result in pressing of button 126 on top of main housing 104, which is typically hidden on top of main housing 104 when rail mountable device 100 is coupled to firearm 100. Thus, button 128 may be disposed on top of rail mountable device 100 or disposed in another area exposed to a lower amount of dust.

Dowel 124 may be coupled to bracket 122 and coupled to main housing 104 (e.g., may be inserted into opening 140). Bracket 122 may include a divot 128 or other such feature formed into bracket 122 or coupled as a separate part. Certain embodiments of bracket 122 may not include divot 128. Movement of switch 106A and/or 106B may cause bracket 122 to pivot around dowel 124 and cause divot 128 to press down on switch 126. Switch 126 may be located on main housing 104 and/or another portion of rail mountable device 100. Pressing of switch 126 may cause the operating mode of light source 117 to change.

Various embodiments of rail mountable device 100 may include one or more seals. For example, battery pack 114 may include seals on one or more surfaces and the top of main housing 104 may additionally include seals. Such seals may further prevent dust or other debris from intruding in sensitive locations of rail mountable device 100 (e.g., may protect ports or buttons of rail mountable device 100).

Figure 3A:
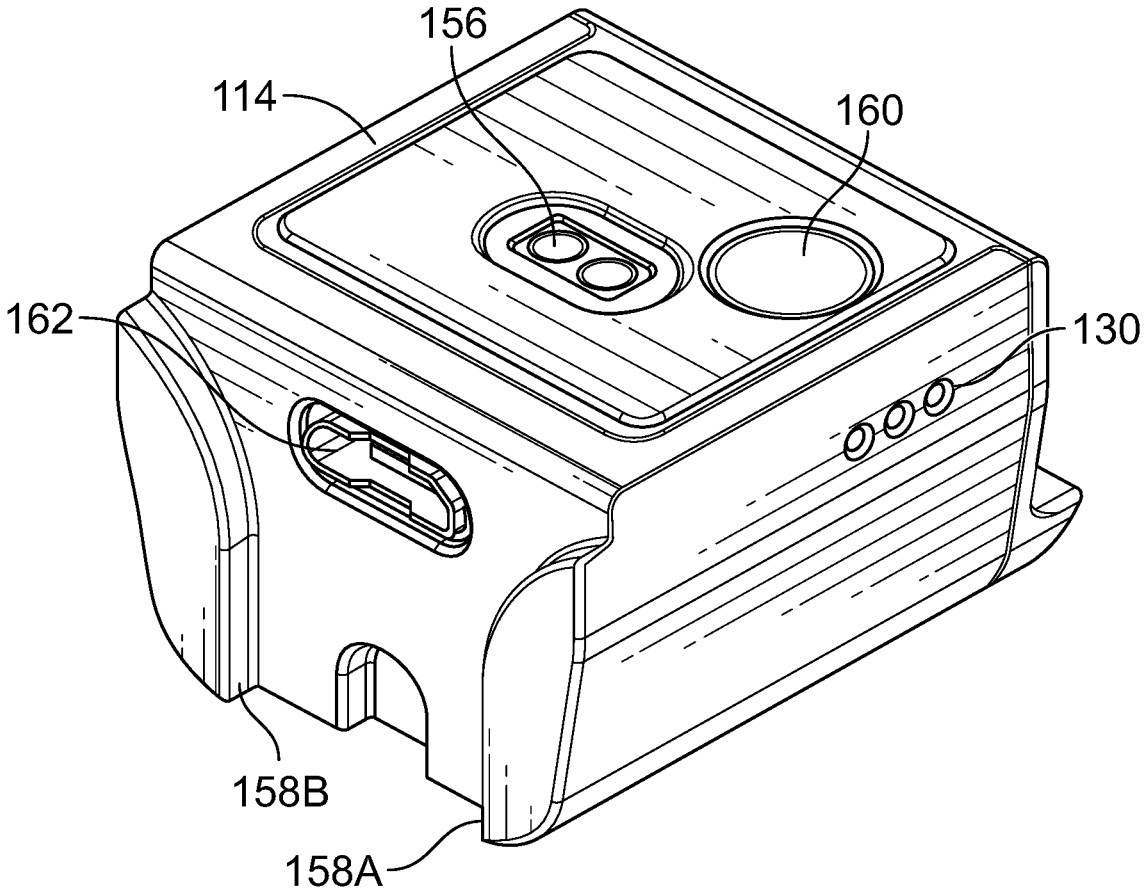
FIGS. 3A-C illustrate views of a removable battery pack of a rail mountable device in accordance with embodiments of the disclosure.
Figure 3B:
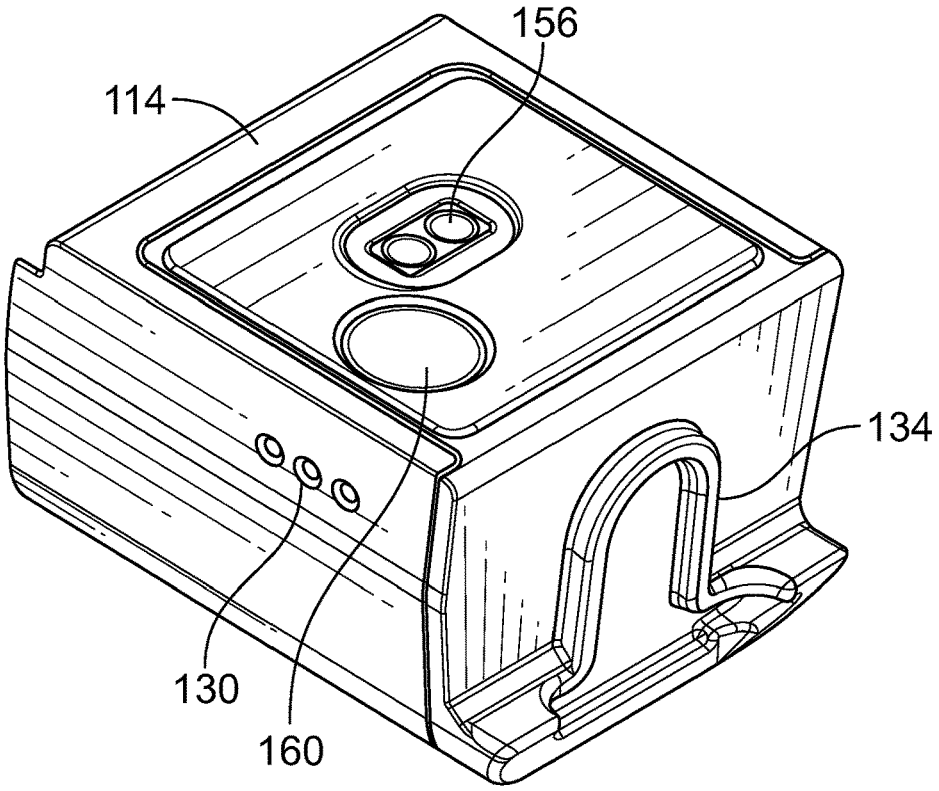

FIG. 2I shows a side view of rail mountable device 100 with battery pack 114 disengaged from main housing 104. Dashed lines may show a possible direction for battery pack 114 to engage main housing 104. As shown in FIG. 2I, one or more contacts of battery pack 114 (e.g., contacts 156 as shown in FIGS. 3A and 3B) may be disposed so that, when battery pack 114 is coupled to main housing 132, contacts 156 are electrically coupled to contacts 132 of main housing 104. Thus, light source 117 may be powered from battery charge of battery pack 114. One or both of contacts 132 and/or 156 may be pogo pins and/or other types of contacts.

Figure 3C:
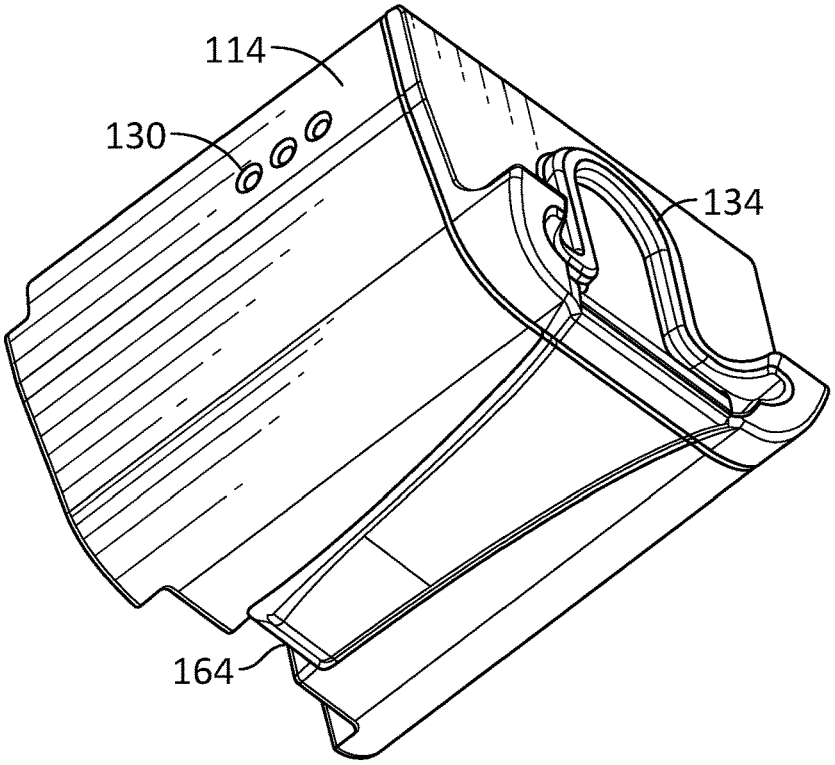

FIGS. 3A-C illustrate views of a removable battery pack of a rail mountable device in accordance with embodiments of the disclosure. Battery pack 114 may include contacts 156, switch 160, battery indicator 130, charging port 162, guides 158A and 158B, ribs 134, and receptacle 164. Contacts 156 may be configured to electrically couple to (e.g., touch) contacts 132 when battery pack 114 is coupled to main housing 104. Switch 160 may be coupled to one or more components of battery pack 114 so that pressing of switch 160 by a user causes battery indicator 130 to indicate the charge remaining for battery pack 114. Switch 160 may be disposed within a portion of battery pack 114 hidden (e.g., obscured) from the environment when battery pack 114 is coupled to main housing 104. Receptacle 164 may engage a portion of battery release 136 to hold and/or release battery pack 114 relative to main housing 104.

Charging port 162 may be configured to receive a connector of a charging cable to charge battery pack 114. Charging port 162 may include any type of connector that can receive battery charge, such as any type of Universal Serial Bus (USB) connector, LIGHTNING CABLE®, or other type of connector. In certain embodiments, charging port 162 may be disposed so the charging port 162 is hidden when battery pack 114 is coupled to main housing 104. Such a configuration may prevent debris from entering into charging port 162 when rail mountable device 100 is operating. Battery pack 114 may further include one or more seals to prevent entrance of such debris.

Guides 158A and 158B may be configured to contact guides 154 of main housing 104 when battery pack 114 is inserted into main housing 104. Guides 158A and 158B may be tapered to aid in positioning contacts 156 relative to contacts 132 when battery pack 114 is inserted into main housing 104 (e.g., aid in guiding positioning of battery pack 114 relative to a portion of main housing 104 such as opening 115 when battery pack 114 is inserted into opening 115).

Figure 4:
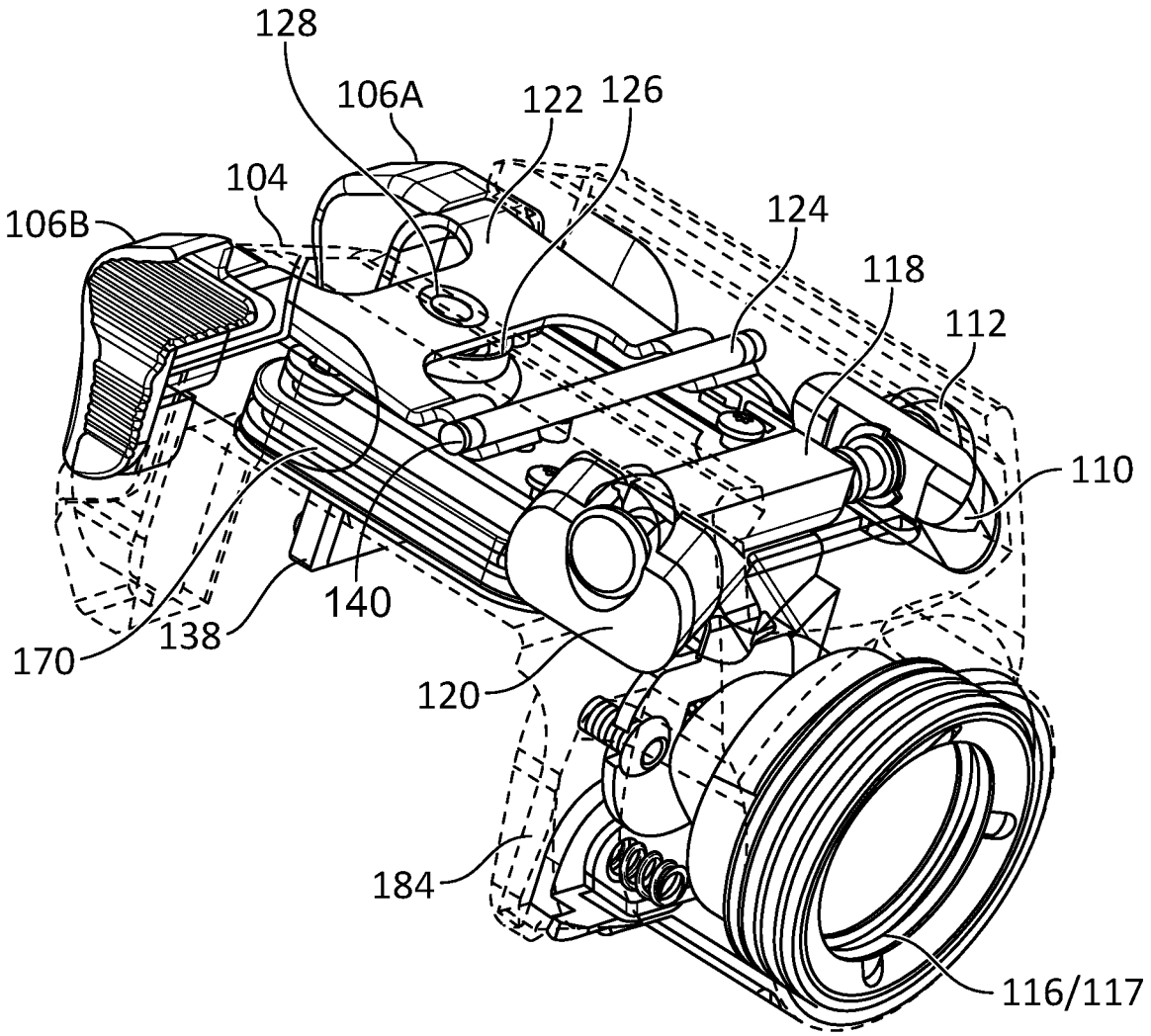
FIG. 4 illustrates a partially transparent view of a rail mountable device in accordance with an embodiment of the disclosure.

FIG. 4 illustrates a partially transparent view of a rail mountable device in accordance with an embodiment of the disclosure. As shown, dowel 124 may be inserted into opening 140 of main housing 104. Additionally, switch 126 may be coupled to electronic circuitry 170. Electronic circuitry 170 may be, for example, a printed circuit board (PCB) or other electronic circuitry that may include a processor, memory, and/or other circuitry configured to detect when switch 126 is pressed (e.g., by divot 128 down to manipulation of switch 106A and/or 106B). For example, in certain embodiments, electronic circuitry 170 may detect that switch 126 has been pressed and may then toggle or cycle through operating modes of optic 116 (e.g., may turn optic 116 on or off or cycle through various lighting settings of optic 116).

Figure 5A:
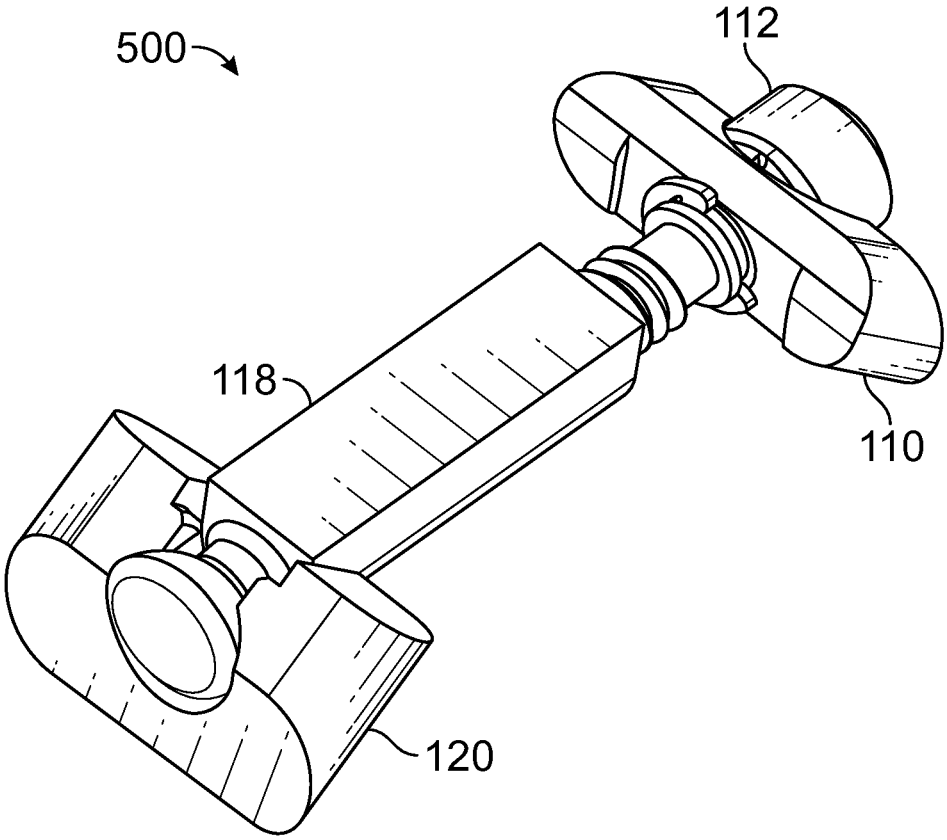
FIGS. 5A-C illustrate views of a rail clamp of a rail mountable device in accordance with embodiments of the disclosure.
Figure 5B:
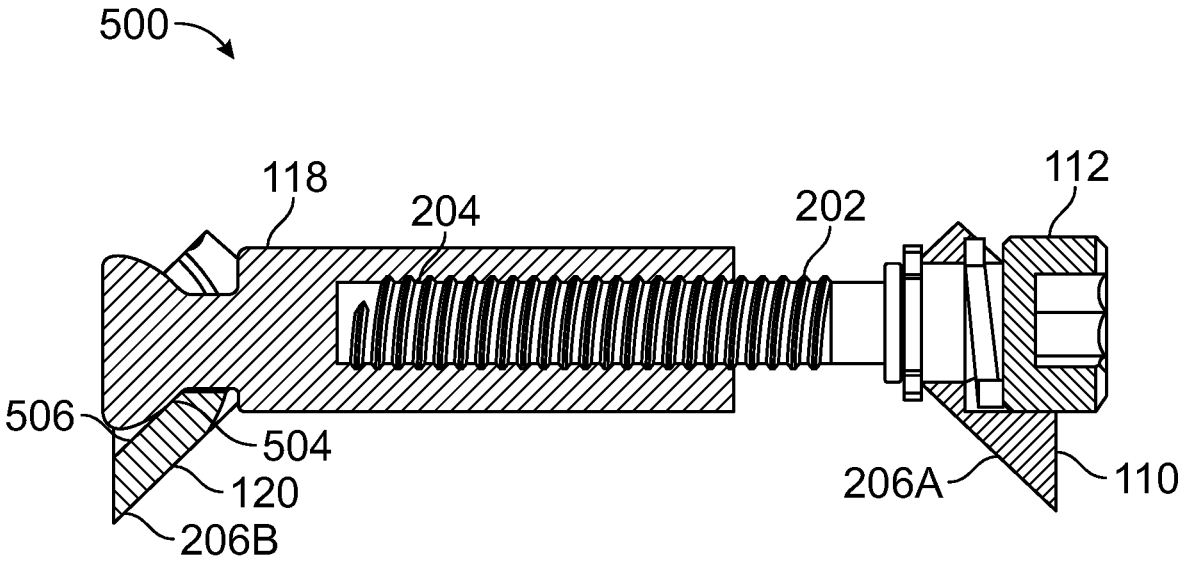
Figure 5C:
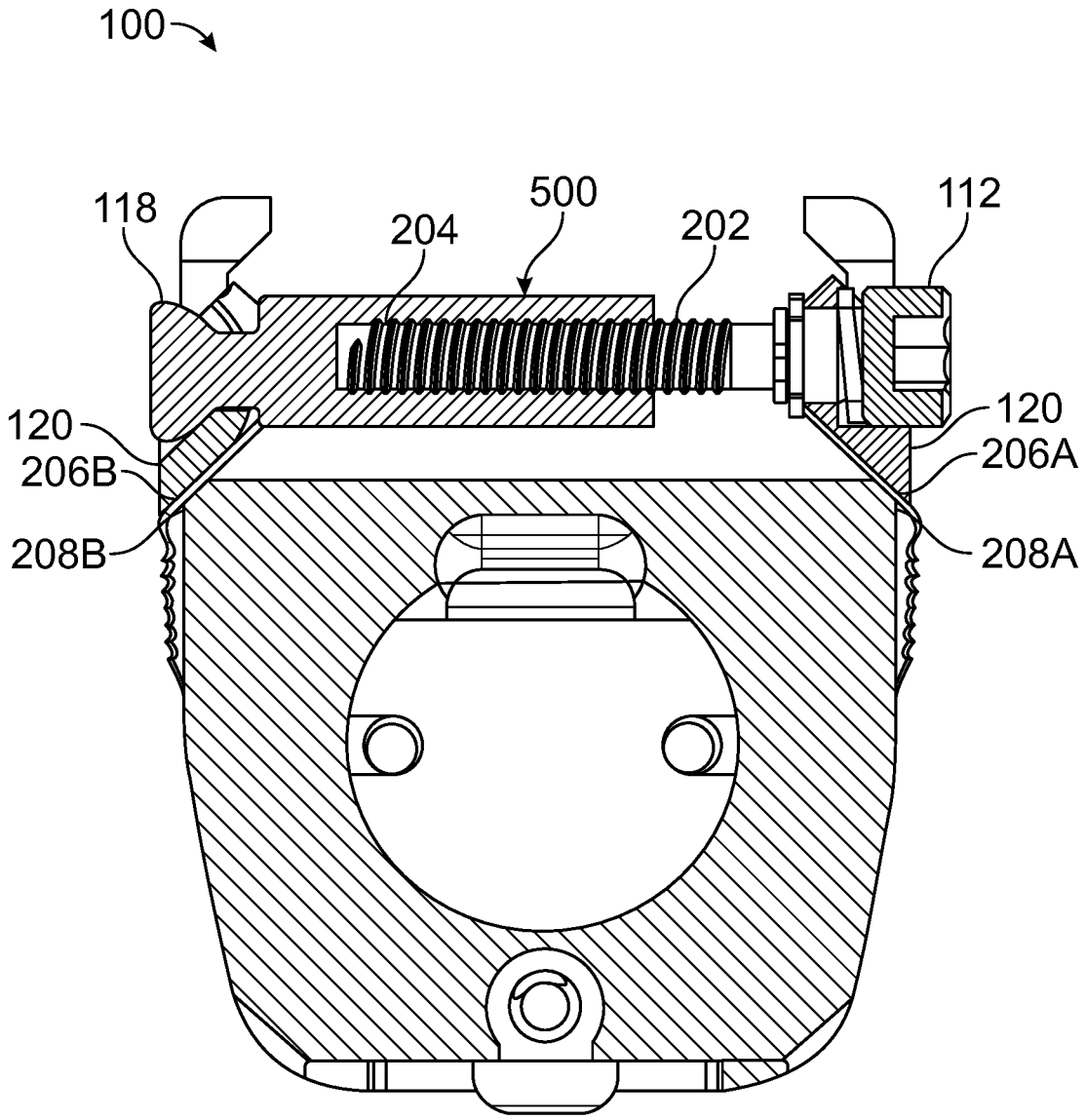

FIGS. 5A-C illustrate views of a rail clamp of a rail mountable device in accordance with embodiments of the disclosure. FIGS. 5A and 5B illustrate components of the rail clamp 500 while FIG. 5C illustrates a cutaway of rail mountable device 100 with the rail clamp 500. As described herein, the rail clamp 500 may include screw 112, screw receptacle 118, and ramp members 110 and 120.

Screw 112 may include screw threads 202 that may be threaded into receptacle threads 204 of screw receptacle 118. As such, screw 112 may be rotated to pull together or push apart screw 112 and screw receptacle 118. Screw 112 may be coupled to and contact a portion of ramp member 110 (e.g., disposed within an opening of ramp member 110). Ramp member 110 may include an angled surface such as rail-engaging surface 206A that is configured to contact a portion or surface of a corresponding other member of main housing 104 (e.g., a corresponding rail-engaging member 102 of main housing 104).

Receptacle threads 204 may be an internally threaded portion of screw receptacle 118. Screw receptacle 118 may be disposed within and include a surface 504 that is configured to contact surface 506 of ramp member 120. Thus, force from tightening of screw 112 with regards to screw receptacle 118 can be transferred to ramp member 120. In certain embodiments, surface 504 may be a flat or curved surface and surface 506 may be shaped to correspondingly accommodate surface 504 and allow for positive engagement between screw receptacle 118 and ramp member 120 while accommodating misalignment.

In certain embodiments, surface 504 may be a curved surface. Such a curved surface may allow for greater misalignment of components of rail clamp 500. Corresponding surface 506, in various embodiments, may, accordingly, be a curved or flat surface. Thus, for example, surface 206A of ramp member 110 may contact rail-engaging surface 208A and surface 206B of ramp member 120 may contact rail-engaging surface 208B and the surfaces may slide against each other (e.g., in response to tightening of screw 112). As shown in FIG. 5C, rail-engaging surfaces 208A and 208B may be disposed on opposing sides of rail mountable device 100 and may be opposing inward directed wedge-shaped surfaces (in cross-section) that run longitudinally (e.g., parallel to length of device 100 from the front to the back in the direction of an intended rail to be mounted).

As each of surfaces 206A, 206B, 208A, and 208B are angled surfaces, there may be misalignment between the surfaces. The combination of screw receptacle 118 and ramp member 120 may allow for accommodation of misalignment between portions of the rail clamp 500 and/or between portions of the rail clamp 500 and main housing 104 (e.g., may allow for surface 206A and 206B to change their angles relative to each other based on the angles of surface 208A and 208B) by, for example, allowing for movement of screw receptacle 118 relative to ramp member 120. Thus, for example, surface 504 may be a curved surface that allows for screw receptacle 118 to rotate relative to ramp member 120. Such a configuration of screw receptacle 118 and ramp member 120 may allow for rail clamp 500 to operate even if there is debris within portions of rail clamp 500. Screw 112 may likewise move relative to ramp member 110.

Figure 6:
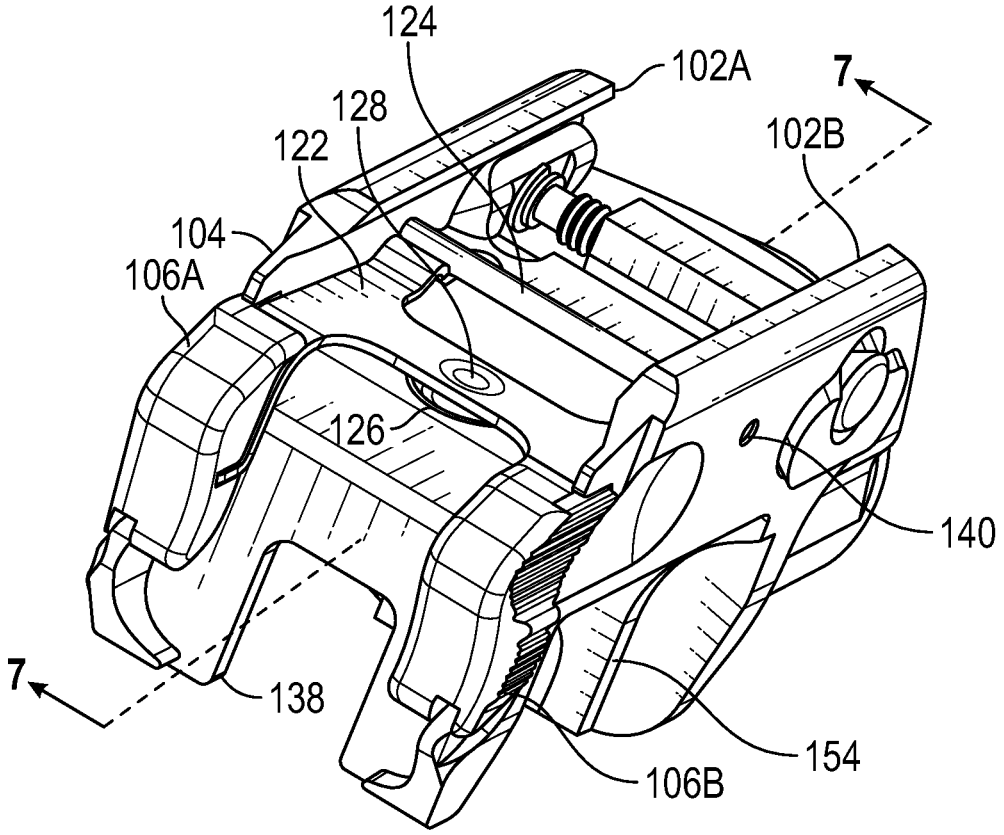
FIG. 6 illustrates a view of a rail mountable device in accordance with an embodiment of the disclosure.

FIG. 6 illustrates a view of a rail mountable device in accordance with an embodiment of the disclosure. FIG. 6 illustrates main housing 104 without battery pack 114 attached. As shown in FIG. 6, bracket 122 can be a partially H shaped bracket connected to both switches 106A and 106B. Additionally, FIG. 6 illustrates contact guides 154, which are configured to interface with guides 158 of battery pack 114.

Figure 7:
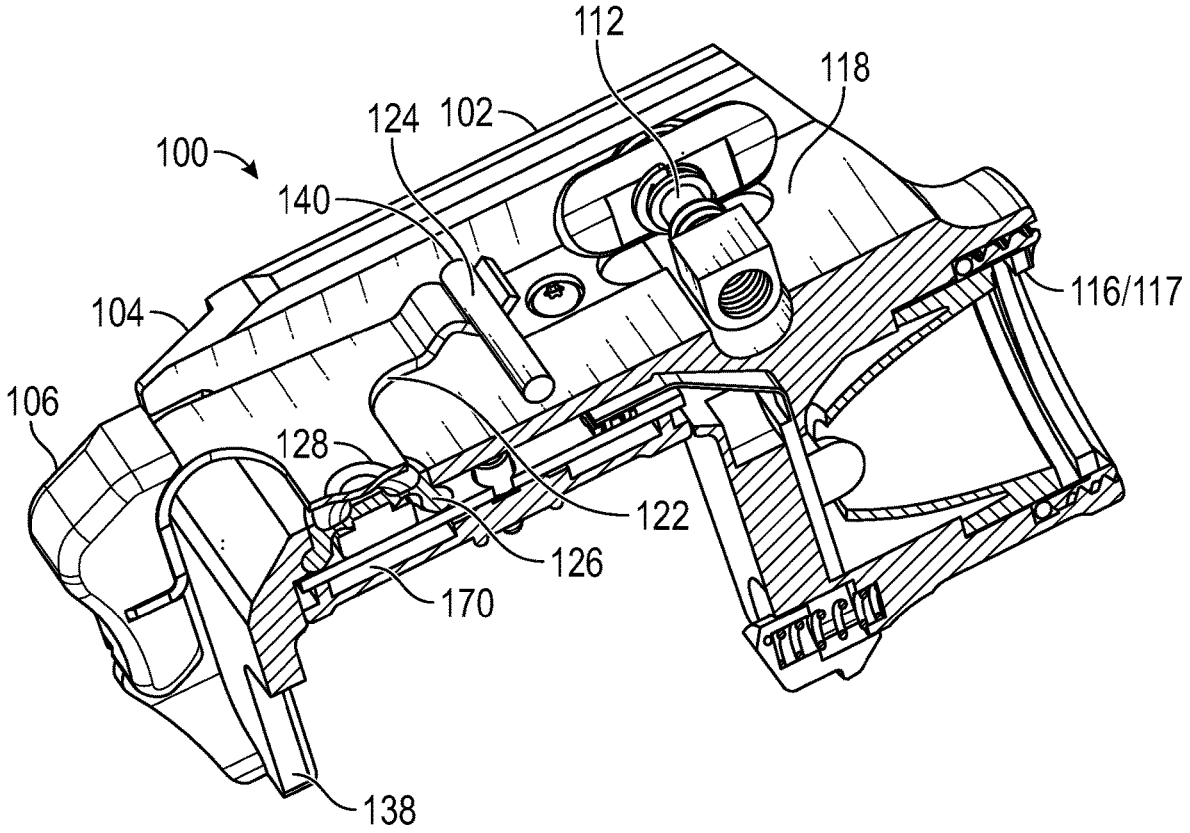
FIG. 7 illustrates a cross-sectional view a rail mountable device, taken at line 7-7 of FIG. 6, in accordance with an embodiment of the disclosure.

FIG. 7 illustrates a cross-sectional view a rail mountable device, taken at line 7-7 of FIG. 6, in accordance with an embodiment of the disclosure. In certain embodiments, bracket 122 may be a stamped and formed sheetmetal piece and switch 106 may be friction-fit, fastened, or glued onto bracket 122. The cross-sectional view of FIG. 7 illustrates that divot 128 is configured to contact switch 126 when switch 106 is pulled or pressed downward. In certain embodiments, bracket 122 may be welded, mechanically coupled, or adhesively coupled to dowel 124. In other embodiments, bracket 122 may include forms that correspond to dowel 124 (e.g., cup shaped forms as shown in FIG. 7 that receive dowel 124). One or more additional features of main housing 104 (e.g., an overhanging ledge as shown in FIG. 7) may prevent movement of bracket 122 and/or switch 106 in a certain direction and, thus, prevent bracket 122 from decoupling from main housing 104.

Figure 8:
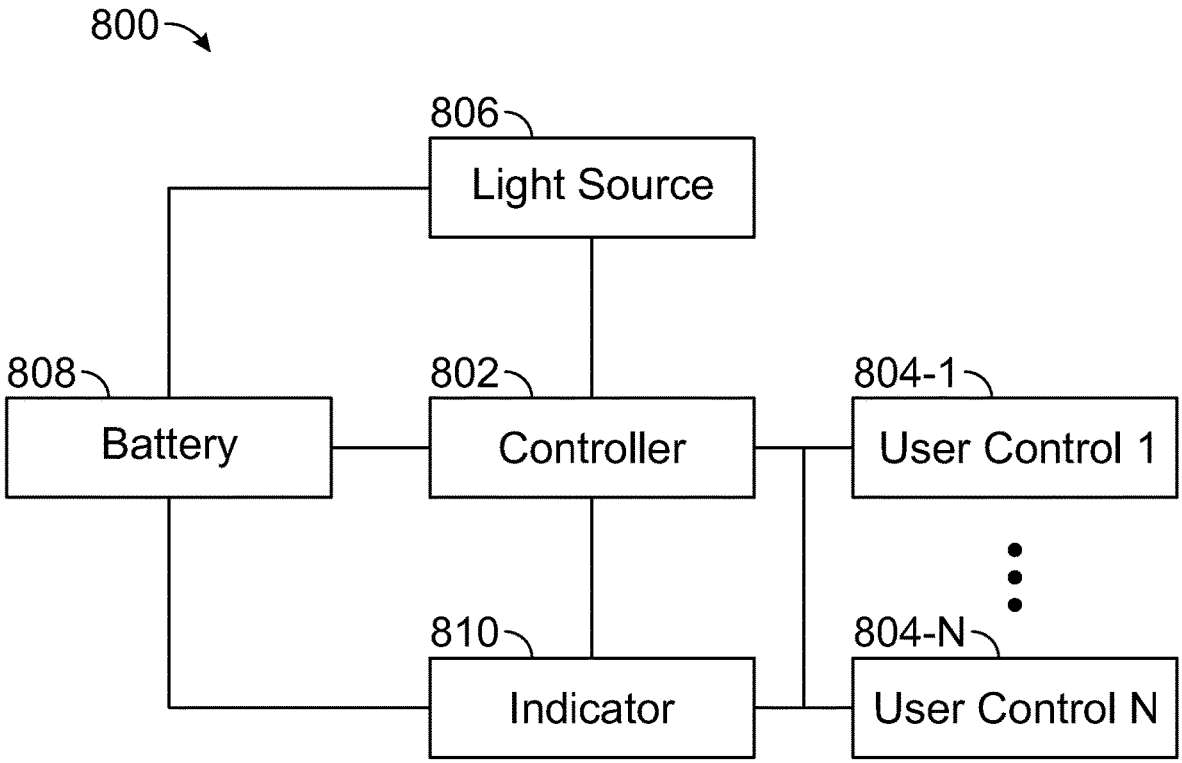
FIG. 8 illustrates a block diagram of a rail mountable device in accordance with an embodiment of the disclosure.

FIG. 8 illustrates a block diagram of a rail mountable device in accordance with an embodiment of the disclosure. FIG. 8 may illustrate components of rail mountable device 100. FIG. 8 includes controller 802, user controls 804, light source 806, battery 808, and indicator 810. The components illustrated in FIG. 8 may be disposed within or coupled to rail mountable device 100.

Controller 802 may include one or more processors, processing circuitry, memory, other logic devices and/or other associated components. Controller 802 may be configured to provide control signals to light source 806 (e.g., optic 116) responsive to operation of one or more user controls 804. Such control signals may include signals to turn light source 806 on or off or signals to adjust a brightness level of light source 806. Rail mountable device 100 may include a plurality of user controls 804-1 to 804-N. Each such user control may be configured to operate an aspect of rail mountable device 100. For example, a first user control 804-1 may toggle light source 806 on and off, a second user control 804-2 may adjust a brightness level of light source 806, and a third user control 804-3 may operate indicator 810 (e.g., battery indicator 130). In various embodiments, any desired number of user controls 804 may be provided.

Light source 806 may be powered by battery 808. Additionally, a charge level of battery 808 may be shown by indicator 810 through illumination of indicator 810. In certain embodiments, indicator 810 may be operated by, for example, operating one of the user controls 804 to cause controller 802 to provide control signals to indicator 810 to show the charge level of battery 808. Other embodiments may continuously show the charge level of battery 808 with indicator 810.

Figure 9:
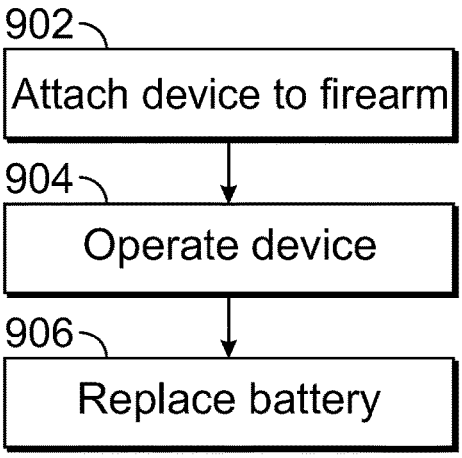
FIG. 9 illustrates a flowchart detailing operation of a rail mountable device in accordance with an embodiment of the disclosure.

FIG. 9 illustrates a flowchart detailing operation of a rail mountable device in accordance with an embodiment of the disclosure. In block 902, rail mountable device 100 may be attached or coupled to firearm 101 in accordance with the various techniques discussed herein. For example, the rail mountable device 100 may include rail clamp 500 and a screw 112 of rail clamp 500 may be tightened to secure rail mountable device 100 to firearm 101.

In block 904, rail mountable device 100 may be operated. For example, a first switch 106 of rail mountable device 100 may be toggled to switch optic 116 of rail mountable device 100 on or off or change a setting of optic 116.

In block 906, a removable battery pack 114 of rail mountable device 100 may be replaced and/or recharged. A second switch 136 may be operated to release removable battery pack 114 from a main housing 104 of rail mountable device 100 while main housing 104 remains attached or coupled to firearm 101. Removable battery pack 114 may then be removed from main housing 104 and recharged and/or another removable battery pack 114 may be inserted into main housing 104 to power rail mountable device 100. In certain embodiments, removable battery pack 114 may include a third switch 160 that, when toggled, allows for a remaining charge of removable battery pack 114 to be displayed.

U.S. Pat. No. 9,551,550 filed Jan. 16, 2015 and issued Jan. 24, 2017 is hereby incorporated by reference in its entirety. U.S. Design patent application Ser. No. 29/670,906 filed Nov. 20, 2018 is hereby incorporated by reference in its entirety. Any of the features set forth in U.S. Pat. No. 9,551,550 and/or U.S. Design patent application Ser. No. 29/670,906 may be used with the features of the present disclosure as appropriate.

The disclosure is not intended to limit the present invention to the precise forms or particular fields of use disclosed. It is contemplated that various alternate embodiments and/or modifications to the present invention, whether explicitly described or implied herein, are possible in the rail clamp of the disclosure. For example, it is contemplated that the various embodiments set forth herein may be combined together and/or separated into additional embodiments where appropriate.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A rail mountable device configured to mount on a rail associated with a weapon, the rail mountable device comprising:

a housing; and a rail clamp comprising:

a screw receptacle, a screw configured to be threaded into the screw receptacle, a first ramp member coupled to the screw and configured to move relative to the screw, and a second ramp member coupled to the screw receptacle and configured to move relative to the screw receptacle, wherein the screw and the screw receptacle are configured to be pulled toward each other in response to a rotation of the screw about an axis in a first direction, and wherein the first ramp member and the second ramp member are configured to be pulled toward each other in response to the pulling together of the screw and the screw receptacle.

2. The rail mountable device of claim 1, wherein the rotation causes the screw to exert a first force on the first ramp member and causes the screw receptacle to exert a second force on the second ramp member.

3. The rail mountable device of claim 1, wherein the screw receptacle comprises a curved surface, wherein the curved surface contacts the second ramp member, wherein the curved surface contacts a flat surface of the second ramp member, and wherein the second ramp member is configured to move relative to the screw receptacle by, at least, rotating relative to the screw receptacle.

4. The rail mountable device of claim 1, wherein the first and second ramp members comprise substantially inclined surfaces relative to the axis, and wherein the inclined surfaces are configured to slide against complementary inclined surfaces of the housing in response to the rotation.

5. The rail mountable device of claim 1, further comprising a removable battery pack configured to selectively couple to and decouple from the housing, wherein the removable battery pack comprises a charging port configured to be obscured when the removable battery pack is coupled to the housing.

6. The rail mountable device of claim 5, wherein the housing comprises:

a housing contact configured to electrically couple to a battery contact when the removable battery pack is coupled to the housing; and a battery release configured to hold the removable battery pack to the housing when the removable battery pack is coupled to the housing and configured to decouple the removable battery pack from the housing when the battery release is moved.

7. The rail mountable device of claim 5, wherein the removable battery pack further comprises:

a battery life indicator; and an indicator button configured to cause the battery life indicator to illuminate to display a remaining charge of the battery pack, wherein the indicator button is configured to be obscured when the removable battery pack is coupled to the housing.

8. The rail mountable device of claim 5, wherein the removable battery pack comprises a rib and the housing comprises an opening, and wherein the rib is configured to contact or be disposed proximate the opening when the removable battery pack is coupled to the housing, and wherein the rib is configured to transfer force received by the battery pack to the housing by contacting the housing.

9. The rail mountable device of claim 1, further comprising:

a bracket coupled to the housing;

a first switch;

a second switch, wherein the first switch and the second switch are disposed on opposite sides of the housing; and a button configured to be actuated by the bracket through manipulation of at least one of the first switch or the second switch.

10. The rail mountable device of claim 9, further comprising a light source, wherein the button is configured to switch an operating mode of the light source when the first switch and/or the second switch is manipulated.

11. The rail mountable device of claim 9, further comprising a dowel, wherein the bracket is coupled to the housing via the dowel.

12. A method comprising:

providing a device configured to mount on a rail associated with a weapon, the device comprising:

a housing, and a rail clamp comprising:

a screw receptacle, a screw configured to be threaded into the screw receptacle, a first ramp member coupled to the screw and configured to move relative to the screw, and a second ramp member coupled to the screw receptacle and configured to move relative to the screw receptacle;

coupling the housing to the rail; and rotating the screw, wherein the screw and the screw receptacle are configured to be pulled toward each other in response to a rotation of the screw about an axis in a first direction, and wherein the first ramp member and the second ramp member are configured to be pulled toward each other in response to the pulling together of the screw and the screw receptacle to lock the device with respect to the weapon.

13. The method of claim 12, wherein the rotation causes the screw to exert a first force on the first ramp member and causes the screw receptacle to exert a second force on the second ramp member.

14. The method of claim 12, wherein the screw receptacle comprises a curved surface, wherein the curved surface contacts the second ramp member, wherein the curved surface contacts a flat surface of the second ramp member, and wherein the second ramp member is configured to move relative to the screw receptacle by, at least, rotating relative to the screw receptacle.

15. The method of claim 12, wherein the first and second ramp members comprise substantially inclined surfaces relative to the axis, and wherein the inclined surfaces are configured to slide against complementary inclined surfaces of the housing in response to the rotation.

16. The method of claim 12, further comprising decoupling a removable battery pack from to the housing, wherein the removable battery pack comprises a charging port configured to be obscured when the removable battery pack is coupled to the housing.

17. The method of claim 16, wherein the housing comprises:

a housing contact configured to electrically couple to a battery contact when the removable battery pack is coupled to the housing; and a battery release configured to hold the removable battery pack to the housing when the removable battery pack is coupled to the housing and configured to decouple the removable battery pack from the housing when the battery release is moved.

18. The method of claim 16, wherein the removable battery pack further comprises:

a battery life indicator; and an indicator button configured to cause the battery life indicator to illuminate to display a remaining charge of the battery pack, wherein the indicator button is configured to be obscured when the removable battery pack is coupled to the housing.

19. The method of claim 12, wherein:

the device further comprises:

a bracket coupled to the housing, a first switch, a second switch, wherein the first switch and the second switch are disposed on opposite sides of the housing, and a button; and the method further comprises receiving a manipulation of at least one of the first switch or the second switch to actuate the button through the bracket.

20. The method of claim 19, wherein the device further comprises a light source, the method further comprising switching an operating mode of the light source in response to the manipulation.

* * * * *